US010145293B2

(12) United States Patent
Huang et al.

(10) Patent No.: US 10,145,293 B2
(45) Date of Patent: Dec. 4, 2018

(54) LOW-EMISSION CYLINDER WITH EXTERNAL SCAVENGING DUCT

(71) Applicant: Zhejiang Zomax Garden Machinery Co., Ltd., Taizhou, Zhejiang (CN)

(72) Inventors: Buxin Huang, Zhejiang (CN); Chuanxin Jin, Zhejiang (CN); Lu Zou, Zhejiang (CN)

(73) Assignee: ZHEJIANG ZOMAX GARDEN MACHINERY CO., LTD., Wenling Taizhou, Zhejiang (CN)

( * ) Notice: Subject to any disclaimer, the term of this patent is extended or adjusted under 35 U.S.C. 154(b) by 119 days.

(21) Appl. No.: 15/208,613

(22) Filed: Jul. 13, 2016

(65) Prior Publication Data

US 2017/0204779 A1 Jul. 20, 2017

(30) Foreign Application Priority Data

Jan. 16, 2016 (CN) ..... 2016 2 0039977 U

(51) Int. Cl.
*F02B 25/06* (2006.01)
*F01P 1/02* (2006.01)
(Continued)

(52) U.S. Cl.
CPC ..... *F02B 25/06* (2013.01); *F01P 1/02* (2013.01); *F02B 25/22* (2013.01); *F02F 1/22* (2013.01);
(Continued)

(58) Field of Classification Search
CPC ... F02B 25/06; F02B 25/22; F01P 1/02; F01P 2001/023; F02F 1/22; F02F 1/002
(Continued)

(56) References Cited

U.S. PATENT DOCUMENTS 6,668,771 B2 * 12/2003 Martinsson ..... F02B 25/14 123/73 A
2002/0005180 A1 * 1/2002 Jonsson ..... F02B 33/04 123/73 PP (Continued)

*Primary Examiner* — Lindsay Low
*Assistant Examiner* — John Bailey
(74) *Attorney, Agent, or Firm* — Global IP Services; Tianhua Gu

(57) ABSTRACT

The present utility model relates to the technical field of engines, in particular to a low-emission cylinder with an external scavenging duct, wherein cylinder side covers are mounted on two opposite side walls of a cylinder body, a top surface of the cylinder body is a top surface of the uppermost cooling fin and a bottom surface thereof is a mounting surface, an exhaust port is provided in an inner cylinder bore of the cylinder body, an exhaust outlet is provided on a side wall of the cylinder body corresponding to the exhaust port, scavenging ports are respectively provided on two side walls in the inner cylinder bore adjacent to the exhaust port, a scavenging bore is provided in the side wall opposite to the exhaust port in an axial direction, a scavenging duct inlet is provided on the mounting surface corresponding to the side wall of the scavenging bore, scavenging grooves are respectively provided outside the side walls corresponding to the scavenging ports, and scavenging duct is formed between the corresponding scavenging port, the scavenging groove, the scavenging bore, the scavenging duct inlet and the cylinder side cover. The advantages are as follows: the low-emission cylinder can not only ensure the power performance and economical efficiency of engines, has low emission values without needing a secondary purification treatment, but can also satisfy the requirements on the limit values of emission standard.

9 Claims, 6 Drawing Sheets

(51) Int. Cl.
*F02F 1/22* (2006.01)
*F02B 25/22* (2006.01)
*F02F 1/00* (2006.01)

(52) U.S. Cl.
CPC ..... *F01P 2001/023* (2013.01); *F02F 1/002* (2013.01)

(58) Field of Classification Search
USPC ..... 123/68, 41.04, 41.69, 41.82 A, 193.3; 261/23.3
See application file for complete search history.

(56) References Cited

U.S. PATENT DOCUMENTS

2002/0134326 A1* 9/2002 Araki ..... F02B 33/04 123/73 A
2004/0244738 A1* 12/2004 Yuasa ..... F02B 25/16 123/73 A
2005/0155563 A1* 7/2005 Yuasa ..... F02B 25/14 123/73 PP
2005/0284430 A1* 12/2005 Yuasa ..... F01M 3/02 123/73 PP
2006/0005795 A1* 1/2006 Yuasa ..... F02B 25/22 123/73 PP
2007/0119396 A1* 5/2007 Yuasa ..... F02B 25/14 123/73 R
2008/0035096 A1* 2/2008 Carlsson ..... F02B 25/22 123/193.2
2009/0095269 A1* 4/2009 Zama ..... F02B 25/22 123/73 A
2010/0037874 A1* 2/2010 Laydera-Collins ..... F02F 1/22 123/65 P
2010/0236082 A1* 9/2010 Naganuma ..... F02B 25/14 30/381
2011/0017182 A1* 1/2011 Koga ..... F02B 25/14 123/73 PP
2011/0146642 A1* 6/2011 Geyer ..... B22C 9/10 123/73 PP
2012/0174881 A1* 7/2012 Taylor ..... F02B 25/04 123/68
2013/0037011 A1* 2/2013 Otsuji ..... F02B 25/02 123/73 PP
2016/0097343 A1* 4/2016 Yamazaki ..... F02B 25/02 123/65 P
2016/0258384 A1* 9/2016 Yasuda ..... F02B 75/02
2017/0175615 A1* 6/2017 Yamazaki ..... F01P 5/04

* cited by examiner

LOW-EMISSION CYLINDER WITH EXTERNAL SCAVENGING DUCT

TECHNICAL FIELD

The present utility model relates to the technical field of engines, in particular to a low-emission cylinder with an external scavenging duct for use in a small two-stroke gasoline engine for a chain saw.

BACKGROUND ART

At present, European and American countries and regions have requirements on limit values of emissions from gasoline engines, i.e., the sum of THC and NOx in the exhaust from a two-stroke engine less than 50 CC shall not exceed 50 g/kW·h, and the second phase standard of emission limit values in China is also the same as the requirement in this standard. In the last decade, various countries in the world have been researching new technologies of engines to deal with the upgrading emission standard and increasingly stricter requirements on emission limit values in different phases. On the market, there are many hand-held gardening tools, such as chain saws, powered by gasoline engines, most of which are small two-stroke gasoline engines.

A person understanding the engine technology would know that an engine with a low polution emission value in exhaust (low-emission) generally has a reasonable combustion process, a relatively high indicated cycle efficiency, and a reasonable gas exchange process. At present, some of the known small two-stroke gasoline engines use a low-emission cylinder, which generally has a combustion chamber, an exhaust port, a gas inlet and two air inlets arranged opposite to the exhaust port, and scavenging ducts arranged on both sides, the scavenging ducts being of a built-in type, and the entire scavenging ducts being on one side of the cylinder. There are three types of scavenging duct: in the first type, the scavenging duct is in communication with an inner cylinder bore and is open; in the second type, the middle section of the scavenging duct is a closed passage; and the third type is relatively complex, in which the middle section of the scavenging duct is a closed passage, a processed square cover is arranged outside the cylinder body, and the processed cover and the cylinder body together form part of the shape of the scavenging duct. Several cooling fins are provided at the periphery of the inner cylinder bore and the combustion chamber.

In the working process of an engine equipped with a low-emission cylinder, a fuel gas mixture enters a crankcase through a gas inlet, air enters the crankcase through an air inlet, the concentrated gas mixture is diluted with part of the air to form a combustible gas mixture with a proper concentration, and the other part of the air is stored in the scavenging duct. After the gas mixture which has entered the combustion chamber in the last cycle is ignited and exploded to apply work, the air stored in the scavenging duct firstly enters the combustion chamber for scavenging, and then the gas mixture enters the combustion chamber through the scavenging duct for further scavenging. During exhausting, the air which enter the combustion chamber first is spaced between the exhaust gas and the gas mixture, the exhausting is carried out in the order of exhaust gas, air and gas mixture, and the exhaust port is closed at a proper time. Emission values of such low-emission engines are generally 70-100 g/kW·h, the exhausted gas performs secondary combustion under the action of a catalyst in a muffler so as to purify the exhaust gas, and the emission value of the post-processed pollutant in the exhaust is generally decreased to about 30 g/kW·h so as to satisfy the requirements on emission values.

With increasingly stricter requirements on low emission of gasoline engines, the engines which can take the power performance, economical efficiency and emission performance into account are more and more complex, and reducing pollutant emissions by improving the design of the engine itself and optimizing operation parameters is a tendency for the development of engines. The engines in the prior art have a high original emission value, and a catalyst purification treatment method is required for secondary treatment of exhaust gas. It is well-known that the secondary combustion of the exhausted gas outside the cylinder under a catalytic effect will generate a high temperature, and has a great influence on the service life and power performance of engines; the catalyst has a short service life, and the conversion efficiency will step down during use; and the use of a catalytic converter will limit the area of an exhaust passage and thus increase the flow resistance of the exhaust.

At present, the traditional cylinder scavenging duct is integrally arranged on one side of the cylinder, that is, the scavenging port and the scavenging duct inlet are on the same side of a cylinder wall. The scavenging duct is generally arranged as a vertical passage or forms an oblique passage at a small angle relative to a cylinder mounting surface, is limited by the cylinder height, the position of the scavenging port and the method for mounting the cylinder, the length of the scavenging duct is relatively short, the closed middle passage has a small volume, and then the total amount of air stored in the closed passage of the scavenging duct is also reduced. Air stored in the scavenging duct firstly performs scavenging in an initial scavenging stage, and then the flue gas mixture follows up for scavenging. In a forced scavenging stage in an exhaust gas process of an engine, three types of gas, i.e., exhaust gas, gas mixture and air, are present in the combustion chamber at the same time, the layer of the exhaust gas and the gas mixture being spaced by air. Due to the flowing of gas and the irregular space in the combustion chamber, the air spacing layer is thin, some of the gas mixture and the exhaust gas are in contact to present mutual permeation, and a very small amount of the gas mixture will be discharged along with the exhaust gas at the end of exhausting stage.

In addition, when air is stored in the closed passage of the scavenging duct, the scavenging duct inlet is an interface of the air and the gas mixture. It is known that in the period from the air being stored in the closed passage until the air exits the closed passage in the cylinder, the air is in full contact with the gas mixture to present mutual permeation, and the larger the area at the scavenging duct inlet, the more the gas mixture and the air mutually permeated; and the greater the ratio of the area to the length of the scavenging duct inlet, the higher the ratio of the gas mixture mutually permeated to the air. The permeation will lower the content of pure air in the combustion chamber, reduce the thickness of the air layer, decrease the spacing effect of the air on the gas mixture and the exhaust gas, and increase the possibility of the gas mixture escaping through the exhaust port.

SUMMARY OF THE INVENTION

Aiming at the above-mentioned defects in the prior art, the object of the present utility model is to provide a low-emission cylinder with an external scavenging duct, which can not only ensure the power performance and economical efficiency of engines, but also has low emission values and does not need secondary purification treatment, and can also satisfy the requirements on limit values of emission standard.

In order to achieve the above-mentioned purpose, the present utility model provides the following technical solution:

a low-emission cylinder with an external scavenging duct, comprising a cylinder body and cylinder side covers, wherein the cylinder side covers are mounted on two opposite side walls of the cylinder body, the upper side of the cylinder body is provided with cooling fins, a top surface of the cylinder body is a top surface of the uppermost cooling fin and a bottom surface thereof is a mounting surface, an inner cylinder bore and a combustion chamber are arranged in the cylinder body, an exhaust port is provided in the inner cylinder bore, an exhaust outlet is provided on a side wall of the cylinder body corresponding to the exhaust port, scavenging ports are respectively provided on two side walls in the inner cylinder bore adjacent to the exhaust port, a scavenging bore is provided in the side wall opposite to the exhaust port in an axial direction, a scavenging duct inlet in communication with the scavenging bore is provided on the mounting surface corresponding to the side wall provided with the scavenging bore, scavenging grooves are respectively provided outside the side walls corresponding to the scavenging ports, one end of the scavenging groove is in communication with the scavenging bore and the other end thereof is in communication with the scavenging port, and a scavenging duct is formed between the corresponding scavenging port, scavenging groove, the scavenging bore, the scavenging duct inlet and the cylinder side cover.

The present utility model is further arranged as follows: the scavenging groove is arranged in a radial direction of the inner cylinder bore, and the scavenging groove and the scavenging bore are perpendicular to each other or form therebetween an included angle which is greater than 0 degrees and smaller than 90 degrees or which is greater than 90 degrees and smaller than 180 degrees.

The present utility model is further arranged as follows: the joint of the scavenging groove and the scavenging bore is of a circular arc transition.

The present utility model is further arranged as follows: the volume of the scavenging duct is not less than 30% of the maximum exhaust volume of the cylinder.

The present utility model is further arranged as follows: the ratio of the area of the scavenging duct inlet to the length of the scavenging duct is not greater than 0.13.

The present utility model is further arranged as follows: the cross-sectional area of the scavenging duct gradually decreases from the scavenging duct inlet to the scavenging port.

The present utility model is further arranged as follows: a protrusion is provided at the position of the cylinder side cover corresponding to the scavenging port, and the protrusion is inserted in the scavenging port.

The present utility model is further arranged as follows: upper and lower edges of the exhaust port are both of a circular arc surface, and the radius of curvature of the upper circular arc surface is less than the radius of curvature of the lower circular arc surface.

The present utility model is further arranged as follows: the cross-sectional area gradually increases from the exhaust port to the exhaust outlet.

The present utility model is further arranged as follows: the combustion chamber is a semi-ellipsoidal chamber, and the ratio of the area of an inner surface to the volume of the combustion chamber is not greater than 6.2.

With the above-mentioned technical solution, the technical effects achieved by the present utility model are as follows:

1. The scavenging duct breaks through the frame of traditional designs and has a scavenging duct inlet arranged on the adjacent side of the scavenging port, that is, the scavenging duct inlet and the exhaust port are on the same side, and the scavenging duct is designed from a built-in type to an external type, such that the length of the scavenging duct is not bound by a limited space of the side surface of the cylinder, and the volume of the closed passage in the scavenging duct increases;

2. Components on the entire closed section of the scavenging duct can be detached into two components, i.e. a cylinder body and a cylinder side cover, and the two components can be respectively processed and formed by a die-casting method;

3. the ratio of the area to the length of the scavenging duct inlet is decreased such that the ratio of the gas mixture mutually permeated to the air is decreased, the effect of the permeable phenomenon on the content of pure air in the combustion chamber may be decreased, the separation effect of air on the gas mixture and exhaust gas is increased, and the possibility of the gas mixture escaping through the exhaust port is decreased; and 4. the low-emission cylinder can not only ensure the power performance and economical efficiency of engines, but also has low emission values and does not need secondary purification treatment, and can also satisfy the requirements on limit values of emission standard.

DESCRIPTION OF THE DRAWINGS

The present utility model will be further explained below in conjunction with the accompanying drawings.

PARTICULAR EMBODIMENTS

Figure 1:
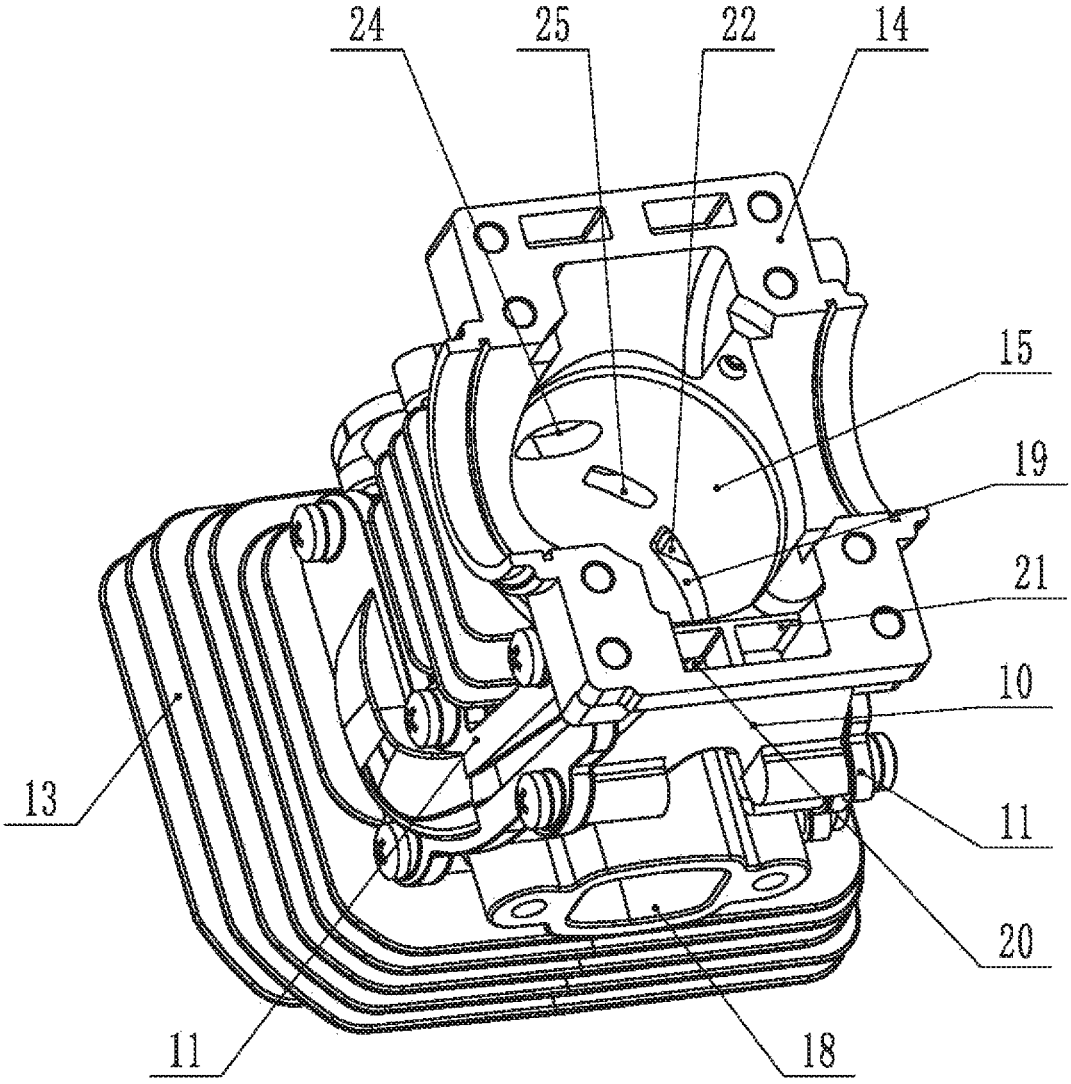
FIG. 1 is a dimensional structural schematic view of the present utility model.
Figure 2:
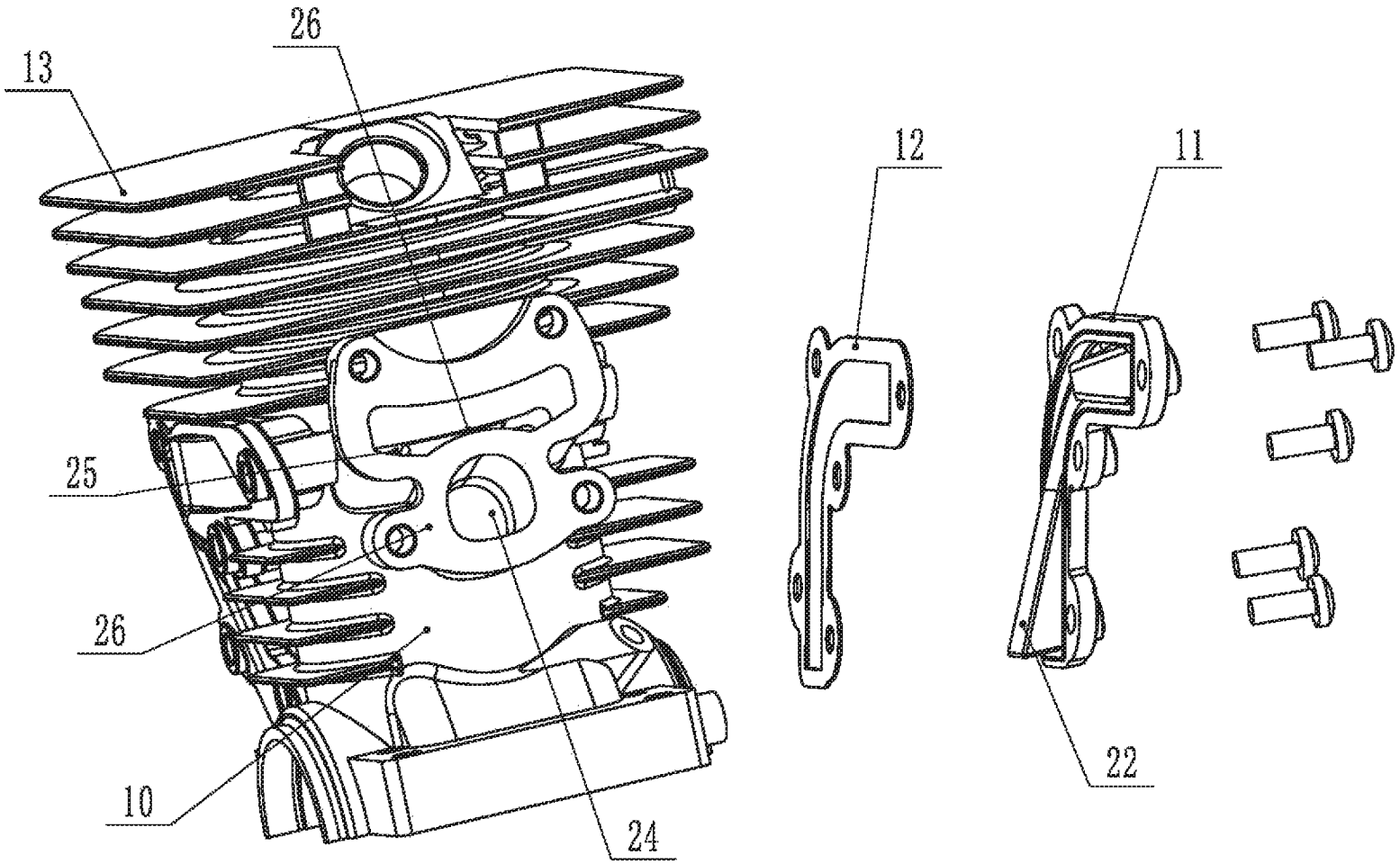
FIG. 2 is an exploded structural schematic view of the present utility model.
Figure 3:
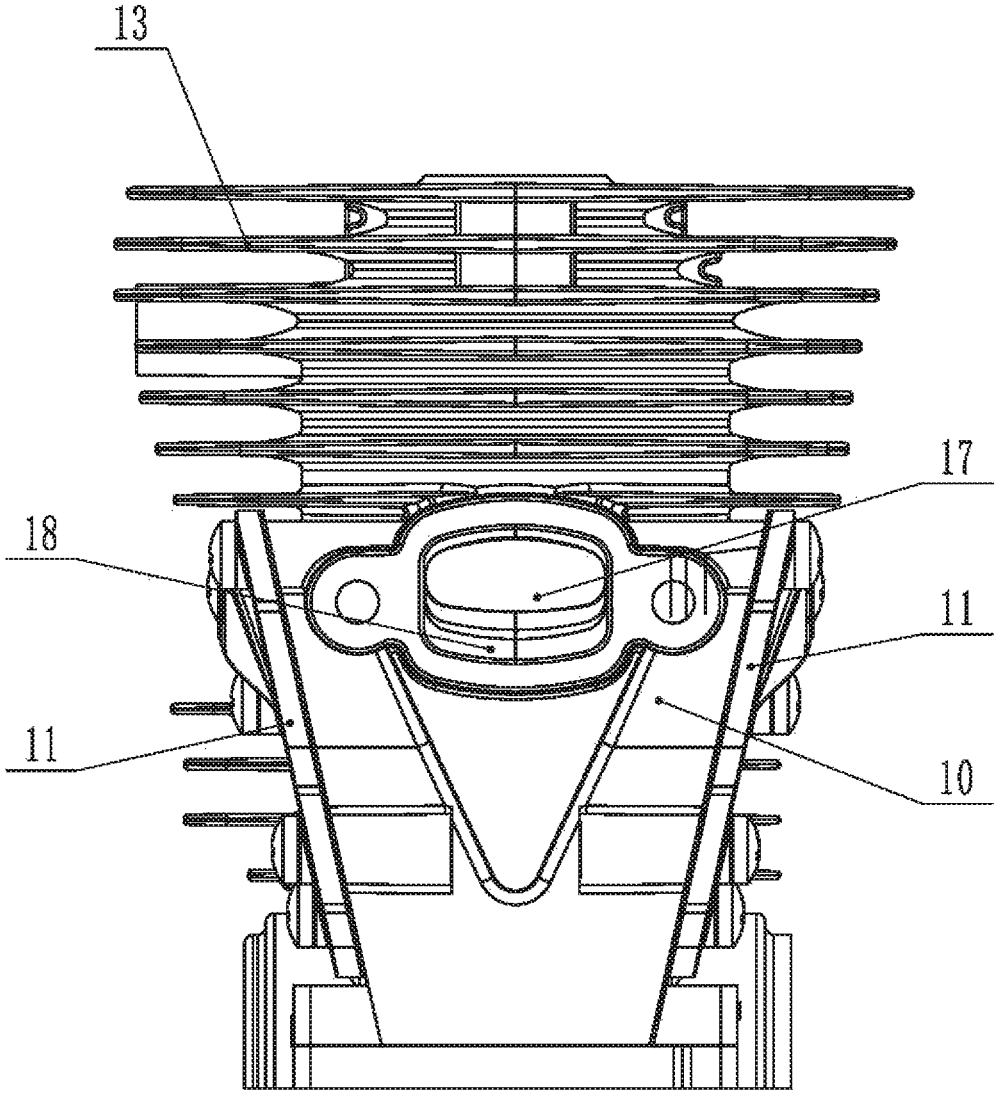
FIG. 3 is a front structural schematic view of the present utility model.
Figure 4:
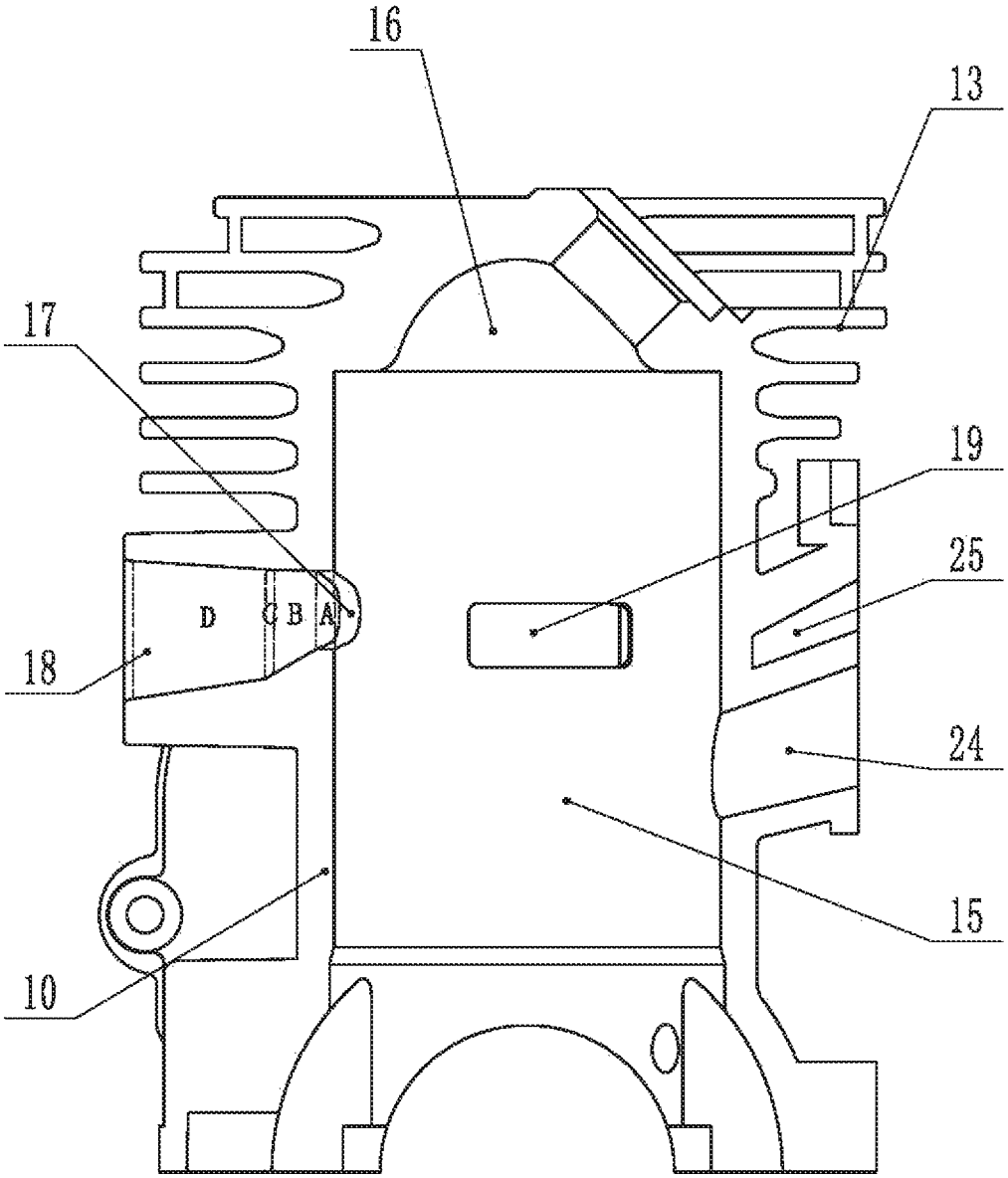
FIG. 4 is a sectional structural schematic view of the present utility model.
Figure 5:
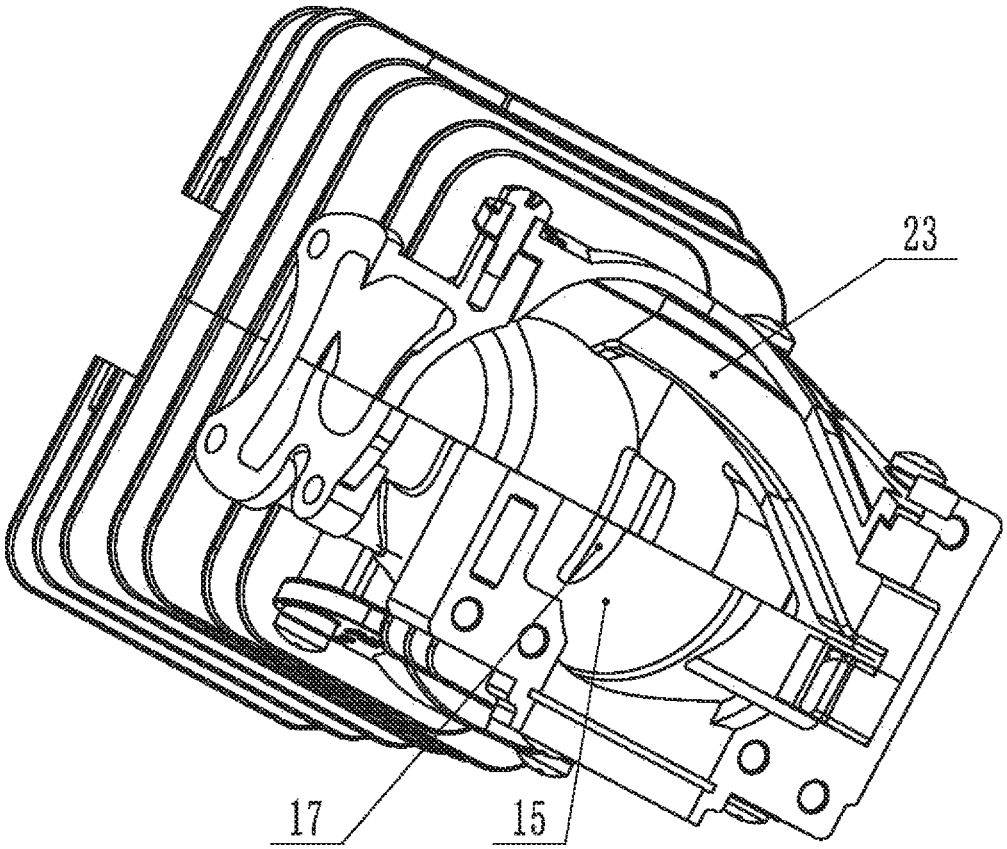
FIG. 5 is a partial sectional structural schematic view of the present utility model.
Figure 6:
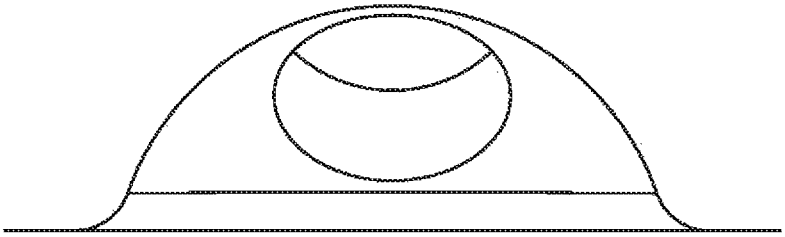
FIG. 6 is a front structural schematic view of the combustion chamber of the present utility model.
Figure 7:
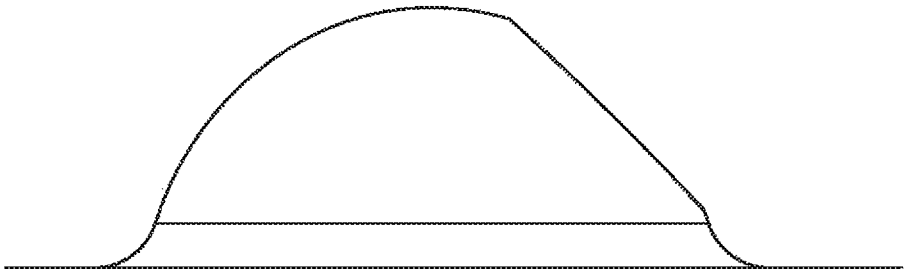
FIG. 7 is a side structural schematic view of the combustion chamber of the present utility model.
Figure 8:
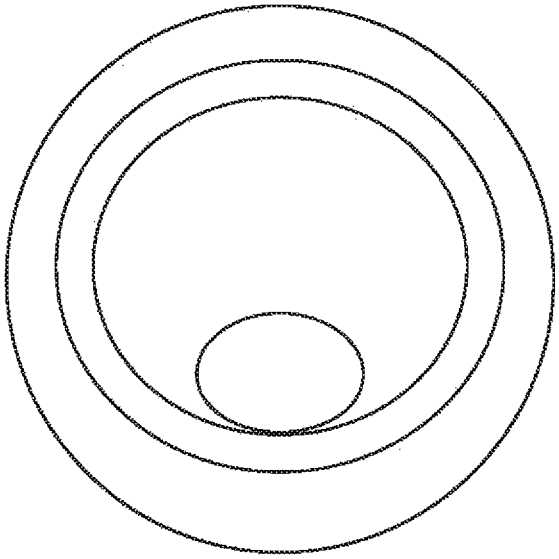
FIG. 8 is a bottom structural schematic view of the combustion chamber of the present utility model.

With reference to FIGS. 1-8, a low-emission cylinder with an external scavenging duct disclosed in the present utility model comprises a cylinder body 10 and cylinder side covers 11, wherein the overall shape of the cylinder body 10 is square with six faces in total, the cylinder body 10 and the cylinder side covers 11 are sealed by a gasket 12 therebetween, and in a general case, the cylinder side covers 11 and the gasket 12 are locked and attached to the cylinder body 10 via screws. The cylinder side covers 11 are mounted on two opposite side walls of the cylinder body 10, the upper side of the cylinder body 10 is provided with cooling fins 13, a top surface of the cylinder body 10 is a top surface of the uppermost cooling fin and a bottom surface thereof is a mounting surface 14, and generally, not less than 10 layers of cooling fins 13 are evenly distributed on the cylinder body 10, with the minimum thickness of a single cooling fin not exceeding 1.3 mm, and with different longitudinal and transverse cross-sectional shapes of the cooling fins 13. The cross sections in the gas inlet and outlet directions are of parallel lines, with the root being V-shaped and in a smooth transition; and the axial cross section is of a shape gradually reducing from outside to inside, with the root being V-shaped and in a smooth transition. Thus, some of heat generated when the engine works is discharged out of the engine body along with exhaust gas generated from combustion, the other part thereof exchanges heat by convection between the cooling fins and the outside air, the heat exchange amount from the cooling fins to the cooling air, except the related structural parameters of the cooling fins themselves, further depends on peripheral flow field distribution, and poor heat dissipation affects power performance and economical efficiency of engines. The cylinder has a large number of cooling fins, the effective heat dissipation area is large, the thickness of the cooling fins and shapes connected among various cooling fins are specially arranged, and the heat dissipation effect is very good.

An inner cylinder bore 15 and a combustion chamber 16 are arranged in the cylinder body 10, an exhaust port 17 is provided in the inner cylinder bore 15, an exhaust outlet 18 is provided on a side wall of the cylinder body 10 corresponding to the exhaust port 17, scavenging ports 19 are respectively provided on two side walls of the inner cylinder bore 15 adjacent to the exhaust port 17, a scavenging bore 20 is provided in the side wall opposite to the exhaust port 17 in an axial direction, a scavenging duct inlet 21 in communication with the scavenging bore 20 is provided on the mounting surface 14 corresponding to the side wall provided with the scavenging bore 20, scavenging grooves 22 are respectively provided outside the side walls corresponding to the scavenging ports 19, one end of the scavenging groove 22 is in communication with the scavenging bore 20 and the other end thereof is in communication with the scavenging port 19, and a scavenging duct 23 is formed between the corresponding scavenging port 19, the scavenging groove, the scavenging bore 20, the scavenging duct inlet 21 and the cylinder side cover 11. The scavenging groove is arranged in a radial direction of the inner cylinder bore 15, and the scavenging groove and the scavenging bore 20 are perpendicular to each other or form therebetween an included angle which is greater than 0 degrees and smaller than 90 degrees or which is greater than 90 degrees and smaller than 180 degrees. The joint of the scavenging groove and the scavenging bore 20 is of a circular arc transition, and such design enables air flow to flow more smoothly in the scavenging duct. The volume of the scavenging duct is not less than 30% of the maximum exhaust volume of the cylinder. The ratio of the area of the scavenging duct inlet to the length of the scavenging duct is not greater than 0.13. The cross-sectional area of the scavenging duct gradually decreases from the scavenging duct inlet to the scavenging port. A protrusion 22 is provided at the position of the cylinder side cover 11 corresponding to the scavenging port 19, and the protrusion 22 is inserted in the scavenging port 19.

As mentioned above, upper and lower edges of the exhaust port 17 are both of a circular arc surface, and the radius of curvature of the upper circular arc surface is less than the radius of curvature of the lower circular arc surface. The cross-sectional area gradually increases from the exhaust port 17 to the exhaust outlet 18. The exhaust outlet 18 is square, with upper and lower edges and four vertex angles being of a circular arc transition, and is formed by connecting four sections of gradient curved surfaces from the exhaust port 17 to the exhaust outlet 18, an upper curved surface gradually extends from inside to outside, a lower curved surface is of a Z shape and extends to the outside, the cross section of the exhaust port forms a trend of increase from inside to outside, with regard to upper and lower curved surfaces from the inner surface, a first section A is approximately parallel, a second section B forms a small included angle, a third section C forms a large included angle, and a fourth section D forms a relatively small included angle. The combustion chamber 16 is a semi-ellipsoidal chamber, and the ratio of the area of an inner surface to the volume of the combustion chamber 16 is not greater than 6.2.

As mentioned above, gas inlets 24 are arranged on the same side with air inlets 25, and are located on opposite side walls of the exhaust port, the air inlets 25 are square and are located on two sides above the gas inlets 24, the air inlets 25 are arranged to be two in number, and two air inlets 25 are communicated by a narrow strip-shaped groove 26 and are on the same mounting surface with the gas inlets 24.

In the working process of an engine equipped with the cylinder, a fuel gas mixture enters a crankcase through a gas inlet, air enters the crankcase through an air inlet, the concentrated gas mixture is diluted with part of the air to form a combustible gas mixture with a proper concentration, and some is stored in the scavenging duct. After the gas mixture having entered the combustion chamber in the last cycle is ignited and exploded to apply work, the air stored in the scavenging duct firstly enters the combustion chamber for scavenging, and then the gas mixture enters the combustion chamber through the scavenging duct for continuously scavenging. During exhausting, the air firstly entering the combustion chamber is spaced between the exhaust gas and the gas mixture, the exhausting is carried out in the order of exhaust gas, air and gas mixture, and the exhaust port is sealed at the proper time. Since the closed passage of the scavenging duct has a large volume, the area of the scavenging duct inlet is small, the amount of stored air is large, and a relatively thick spacer layer is formed in the combustion chamber, such that the amount of the gas mixture escaping during exhausting is less. Exhaust gas is directly discharged out of the engines during exhausting, and the emission value of such low-emission engine is generally about 40 g/kW·h and can satisfy the requirements of emission limit values.

The above-mentioned embodiments are merely preferred embodiments of the present utility model, and are not used to limit the scope of protection of the present utility model, and therefore equivalent changes made according to the structure, shape and principle of the present utility model shall be contained within the scope of protection of the present utility model.

What is claimed is:

1. A low-emission cylinder with an external scavenging duct comprising:

a cylinder body;

cylinder side covers mounted on two opposite side walls of the cylinder body, cooling fins provided on an upper side of the cylinder body;

a top surface of the cylinder body being a top surface of the uppermost cooling fin and a bottom surface of the cylinder body being a mounting surface;

an inner cylinder bore;

a combustion chamber being provided inside the cylinder body;

an exhaust port being provided in the inner cylinder bore;

an exhaust outlet being provided on a side wall of the cylinder body corresponding to the exhaust port; wherein a scavenging device comprising:

scavenging ports respectively provided on two side walls in the inner cylinder bore adjacent to the exhaust port, a scavenging bore provided in a side wall opposite to the exhaust port in an axial direction, a scavenging duct inlet in communication with the scavenging bore provided on the mounting surface corresponding to the side wall provided with the scavenging bore, scavenging grooves respectively provided outside the side walls corresponding to the scavenging ports, one end of the scavenging groove is in communication with the scavenging bore and the other end of the scavenging groove is in communication with the scavenging port, and a scavenging duct formed between the corresponding scavenging port, the scavenging groove, the scavenging bore, the scavenging duct inlet and the cylinder side cover, the volume of the scavenging duct is not less than 30% of the maximum exhaust volume of the cylinder.

2. The low-emission cylinder with an external scavenging duct according to claim 1, wherein the scavenging groove is arranged in a radial direction of the inner cylinder bore, and the scavenging groove and the scavenging bore are perpendicular to each other or form therebetween an included angle which is greater than 0 degrees and smaller than 90 degrees or which is greater than 90 degrees and smaller than 180 degrees.

3. The low-emission cylinder with an external scavenging duct according to claim 2, wherein the joint of the scavenging groove and the scavenging bore is of a circular arc transition.

4. The low-emission cylinder with an external scavenging duct according to claim 1, wherein the ratio of the area of the scavenging duct inlet to the length of the scavenging duct is not greater than 0.13.

5. The low-emission cylinder with an external scavenging duct according to claim 1, wherein the cross-sectional area of the scavenging duct decreases from the scavenging duct inlet to the scavenging port.

6. The low-emission cylinder with an external scavenging duct according to claim 1, wherein a protrusion is provided at the position of the cylinder side cover corresponding to the scavenging port, and the protrusion is inserted in the scavenging port.

7. The low-emission cylinder with an external scavenging duct according to claim 1, wherein upper and lower edges of the exhaust port are both of a circular arc surface, and the radius of curvature of the upper circular arc surface is less than the radius of curvature of the lower circular arc surface.

8. The low-emission cylinder with an external scavenging duct according to claim 1, wherein the cross-sectional area increases from the exhaust port to the exhaust outlet.

9. The low-emission cylinder with an external scavenging duct according to any one of claim 1, wherein the combustion chamber is a semi-ellipsoidal chamber, and the ratio of the area of an inner surface to the volume of the combustion chamber is not greater than 6.2.

* * * * *